US010180273B2

(12) United States Patent
Koo

(10) Patent No.: US 10,180,273 B2
(45) Date of Patent: Jan. 15, 2019

(54) ICE MAKING SYSTEM AND METHOD FOR A REFRIGERATOR

(71) Applicant: Dongbu Daewoo Electronics Corporation, Seoul (KR)

(72) Inventor: Min Bon Koo, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 152 days.

(21) Appl. No.: 14/840,029

(22) Filed: Aug. 30, 2015

(65) Prior Publication Data

US 2016/0370059 A1 Dec. 22, 2016

(30) Foreign Application Priority Data

Jun. 16, 2015 (KR) ..... 10-2015-0085276

(51) Int. Cl.

| | |
|---|---|
| ***F25C 1/04*** | (2018.01) |
| ***F25C 5/20*** | (2018.01) |
| ***F25D 17/06*** | (2006.01) |
| ***F25D 23/06*** | (2006.01) |
| ***F25D 11/02*** | (2006.01) |
| ***F25D 11/00*** | (2006.01) |
| ***F25D 23/02*** | (2006.01) |
| ***F25D 21/14*** | (2006.01) |
| ***F25D 21/06*** | (2006.01) |

(52) U.S. Cl.

CPC ..... *F25C 1/04* (2013.01); *F25C 5/22* (2018.01); *F25D 11/006* (2013.01); *F25D 11/02* (2013.01); *F25D 17/062* (2013.01); *F25D 23/028* (2013.01); *F25D 23/068* (2013.01); *F25C 2400/10* (2013.01); *F25D 21/06* (2013.01); *F25D 21/14* (2013.01); *F25D 2317/062* (2013.01)

(58) Field of Classification Search

CPC ..... F25D 17/065; F25D 17/062; F25D 21/14; F25C 1/24; F25C 1/08; F25C 1/04; F25C 5/005; F25C 2400/10

USPC ..... 62/66

See application file for complete search history.

(56) References Cited

U.S. PATENT DOCUMENTS

| | | | | |
|---|---|---|---|---|
| 3,568,465 A * | 3/1971 | Jung | F25D 17/065 62/272 |
| 5,009,080 A * | 4/1991 | Naganuma | A47F 3/0404 454/193 |
| 8,434,322 B2 | 5/2013 | Lee et al. | |

(Continued)

FOREIGN PATENT DOCUMENTS

| | | |
|---|---|---|
| KR | 10-2005-0098135 | 10/2005 |
| KR | 10-2006-0039169 A | 5/2006 |
| KR | 10-20100111481 A | 10/2010 |

OTHER PUBLICATIONS

Extended European Search Report dated Nov. 14, 2016 issued in corresponding European Patent Application No. 15186864.3.

*Primary Examiner* — Frantz Jules
*Assistant Examiner* — Steve Tanenbaum

(57) ABSTRACT

An ice making system includes an ice making unit that makes ice cubes; a cold air generator unit that cools air inside a cooling duct so as to produce cold air, a cold air circulation unit that supplies the cold air from the cold air generator to the ice making unit and discharges the cold air from the ice making unit to the cold air generator, and a drainage unit that drains defrost water produced from the cooling duct to an outside.

15 Claims, 6 Drawing Sheets

(56) References Cited

U.S. PATENT DOCUMENTS

| | | | | |
|---|---|---|---|---|
| 2003/0101741 | A1* | 6/2003 | Wiseman | F25C 5/22 62/347 |
| 2005/0210909 | A1 | 9/2005 | Kim et al. | |
| 2008/0148761 | A1* | 6/2008 | Venkatakrishnan | F25D 17/065 62/340 |
| 2010/0101260 | A1 | 4/2010 | Lee et al. | |
| 2010/0251748 | A1 | 10/2010 | Park | |
| 2010/0326096 | A1 | 12/2010 | Junge et al. | |

* cited by examiner

ICE MAKING SYSTEM AND METHOD FOR A REFRIGERATOR

CROSS-REFERENCE TO RELATED APPLICATIONS

The present application claims priority to and the benefit of the Republic of Korea Patent Application Serial Number 10-2015-0085276, having a filing date of Jun. 16, 2015, filed in the Korean Intellectual Property Office, the disclosure of which is herein incorporated by reference in its entirety.

FIELD OF THE INVENTION

The present invention relates to an ice making system and method for a refrigerator.

BACKGROUND

A refrigerator unit is an apparatus that functions to store food at low temperatures. The refrigerator unit may store food in a frozen state or in a refrigerated state according to the types of food to be stored.

The interior of a refrigerator unit is cooled by cold air that is continuously supplied to the refrigerator unit. The cold air is continuously generated through a heat exchanging operation between air and a refrigerant performed in a refrigeration cycle. The cycle includes processes of compression, condensation, expansion, and evaporation that are sequentially performed. The cold air supplied to the interior of the refrigerator unit is evenly distributed due to convection of air, so that the cold air can store food, drink, and other items within the refrigerator unit at desired temperatures.

The main body of a refrigerator unit typically has a rectangular, hexahedral shape which is open at a front surface. The front surface may provide access to a refrigeration compartment and a freezer compartment defined within the body of the refrigerator unit. Further, hinged doors may be fitted to the front side of the refrigerator body in order to selectively open and/or close openings to the refrigeration compartment and the freezer compartment. In addition, the storage space defined inside the refrigeration compartment and the freezer compartment of the refrigerator unit may be provided with a plurality of drawers, shelves, and boxes that are configured for optimally storing various kinds of foods, drinks, and other items.

In the related art, refrigerator units were configured as a top mount type refrigerator in which a freezer compartment is positioned in the upper part of the refrigerator body, and the refrigeration compartment is positioned in the lower part of the refrigerator body. Recently, to enhance user convenience bottom freezer type refrigerator units position the freezer compartment below the refrigeration compartment. In the bottom freezer type refrigerator unit, the more frequently used refrigeration compartment is advantageously positioned in the upper part of the refrigerator body so that a user may conveniently access the refrigeration compartment without bending over at the waist, as previously required by the top mount type refrigerator unit. The less frequently used freezer compartment is positioned in the lower part of the refrigerator body.

However, a bottom freezer type refrigerator unit, in which the freezer compartment is provided in the lower part, may lose its design benefits when a user wants to access the lower freezer compartment more frequently than anticipated, such as to take ice cubes. In a bottom freezer type refrigerator unit, the user would have to bend over at the waist in order to open the freezer compartment door and access the ice cubes.

In order to solve such a problem, bottom type refrigerators may include an ice dispenser for dispensing ice cubes that is provided in a refrigerator compartment door. In this case, the ice dispenser is also placed in the upper part of a bottom freezer type refrigerator, and more specifically is located above the freezer compartment. In this refrigerator unit, an ice making device for making ice cubes may be provided in the refrigeration compartment door, or in the interior of the refrigeration compartment.

For example, in a bottom freezer type refrigerator having an ice making device in the refrigeration compartment door, cold air that has been produced by an evaporator is divided and discharged both into the freezer compartment and into the refrigeration compartment. In particular, cold air that was discharged into the freezer compartment flows to the ice making device via a cold air supply duct arranged in a sidewall of the body of the refrigerator unit, and then freezes water while circulating inside the ice making device. Thereafter, the cold air is discharged from the ice making device into the refrigeration compartment via a cold air restoration duct arranged in the sidewall of the body of the refrigerator unit, so the cold air can reduce the temperature inside the refrigeration compartment.

However, because cold air flows through multiple ducts when making ice cubes using the ice making device in the above-mentioned refrigerator, the efficiency of the refrigerator unit may be lessened. That is, because cold air flows to the ice making device via the cold air supply duct, and then flows from the ice making device to the refrigeration compartment via the cold air restoration duct, the efficiency of supplying cold air for the refrigerator unit may be less than optimum.

Further, frost may be produced in both the cold air supply duct and the cold air restoration duct due to the cold air. When the cold air supply duct and the cold air restoration duct are not sufficiently defrosted, the cold air may not be efficiently supplied to the ice making device and the refrigeration compartment, in part due to blockage. This may cause a problem in that an excessive amount of electricity may be wasted during the operation of the refrigerator unit to overcome the effects of frost.

SUMMARY

In view of the above, therefore, embodiments of the present invention provide an ice making system and method for a refrigerator unit in which cold air produced from a cooling duct can be efficiently used to make ice cubes, and from which defrost water produced from the cooling duct can be efficiently drained to the outside.

In one embodiment of the present invention, there is provided an ice making system for a refrigerator unit, including: an ice making unit that makes ice cubes; a cold air generator that cools air inside a cooling duct so as to produce cold air; a cold air circulation unit that supplies the cold air from the cold air generator to the ice making unit, and discharges the cold air from the ice making unit to the cold air generator; and a drainage unit that drains defrost water produced from the cooling duct to the outside.

Advantages of embodiments of the present invention include the ability of a refrigerator unit to efficiently defrost the cooling duct, and efficiently drain defrost water produced during the defrosting process to the outside of the cooling duct.

Another advantage of embodiments of the present invention includes the ability of a refrigerator unit to make ice cubes using the cold air directly produced from the cooling duct, thereby increasing the efficiencies of making ice and supplying cold air.

Still another advantage of embodiments of the present invention include the ability of a refrigerator unit to circulate cold air only a short distance within an ice making space defined between the cooling duct and the refrigeration compartment door, when compared to a conventional technique in which cold air produced from the lower part of a refrigerator unit flows to an ice making space defined in a refrigeration compartment door located in the upper part of the refrigerator unit. As such, embodiments of the present invention can reduce loss of cold air when making ice by reducing the distance of travel of cold air, thereby increasing the efficiency of the ice making unit, and saving electricity during an operation of the refrigerator unit.

In another embodiment, an ice making method for a refrigerator is disclosed, and includes: cooling air using a cooling duct so as to produce cold air; supplying the cold air to an ice making unit so as to make ice cubes; discharging the cold air from the ice making unit to the cooling duct; cooling the discharged cold air again in the cooling duct; defrosting the cooling duct by heating the cooling duct, thereby producing defrost water; and draining the defrost water to an outside.

In still another embodiment, a refrigerator is disclosed, and includes: a freezer compartment located within a main body of the refrigerator; a refrigeration compartment located within the main body of the refrigerator, wherein the freezer compartment is located below the refrigeration compartment; an ice making unit that makes ice cubes; a cold air generator that cools air inside a cooling duct so as to produce cold air; a cold air circulation unit that supplies the cold air from the cold air generator to the ice making unit and discharges the cold air from the ice making unit to the cold air generator; and a drainage unit that drains defrost water produced from the cooling duct to the outside.

BRIEF DESCRIPTION OF THE DRAWINGS

The above and other objects and features of the present invention will become apparent from the following description of exemplary embodiments given in conjunction with the accompanying drawings, which are incorporated in and form a part of this specification and in which like numerals depict like elements, in which.

DETAILED DESCRIPTION

Hereinafter, exemplary embodiments of the present invention will be described in detail with reference to the accompanying drawings so that they can be readily implemented by those skilled in the art. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, functions, constituents, procedures, and components have not been described in detail so as not to unnecessarily obscure aspects and/or features of the present disclosure.

Figure 1:
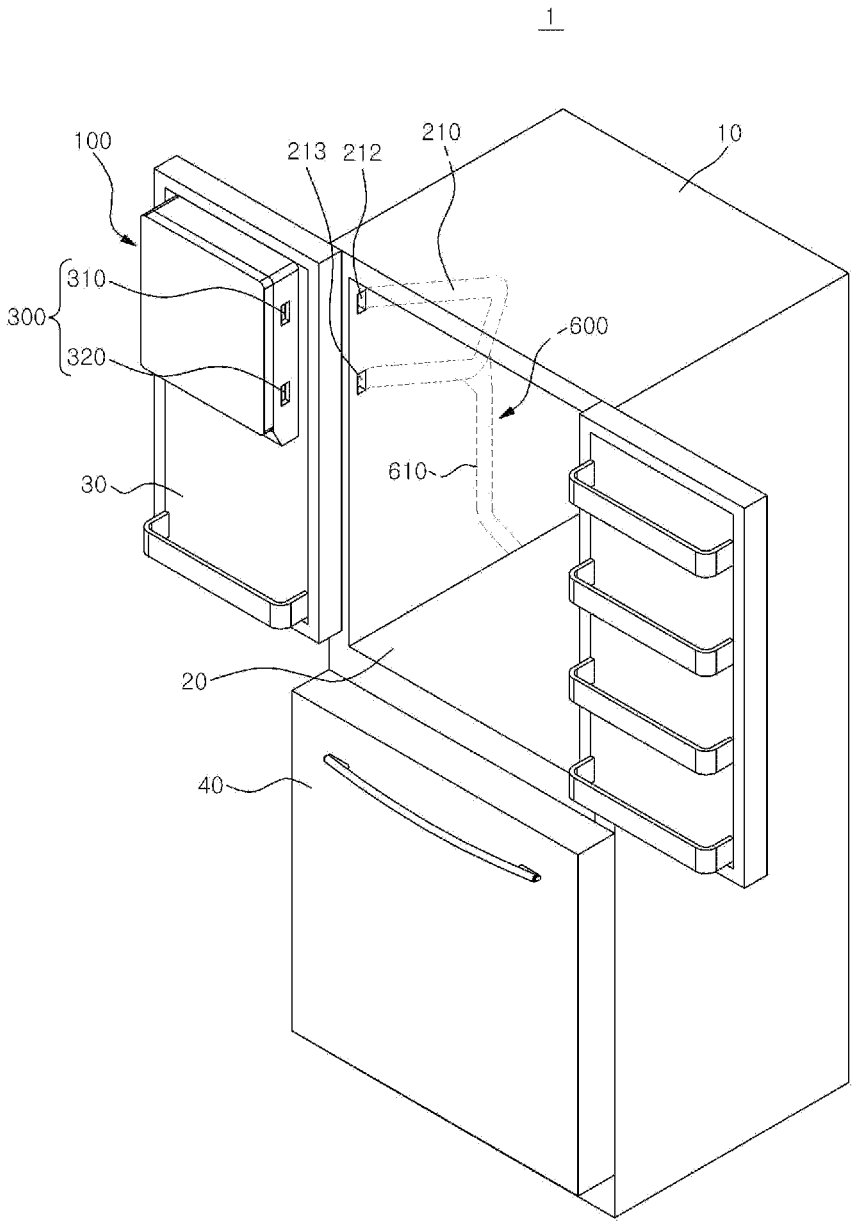
FIG. 1 is a perspective view of a refrigerator unit showing an ice making system, in accordance with one embodiment of the present disclosure.
Figure 2:
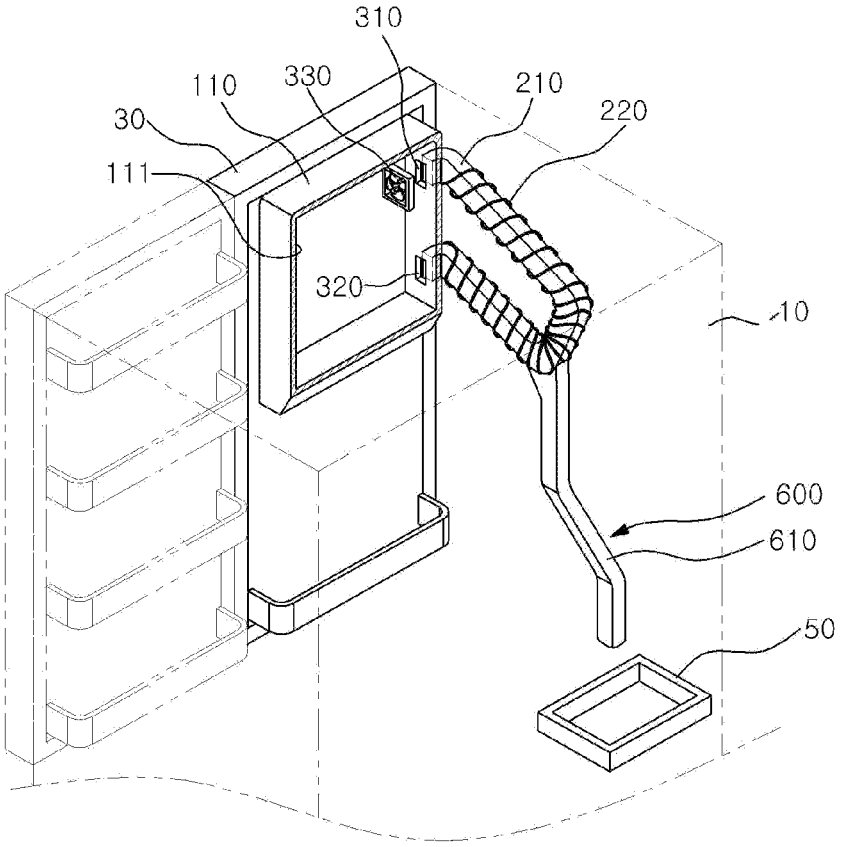
FIG. 2 is a view showing a connection between an ice making unit and a cooling duct of a cold air generator in the ice making system for the refrigerator unit, in accordance with one embodiment of the present disclosure.
Figure 3:
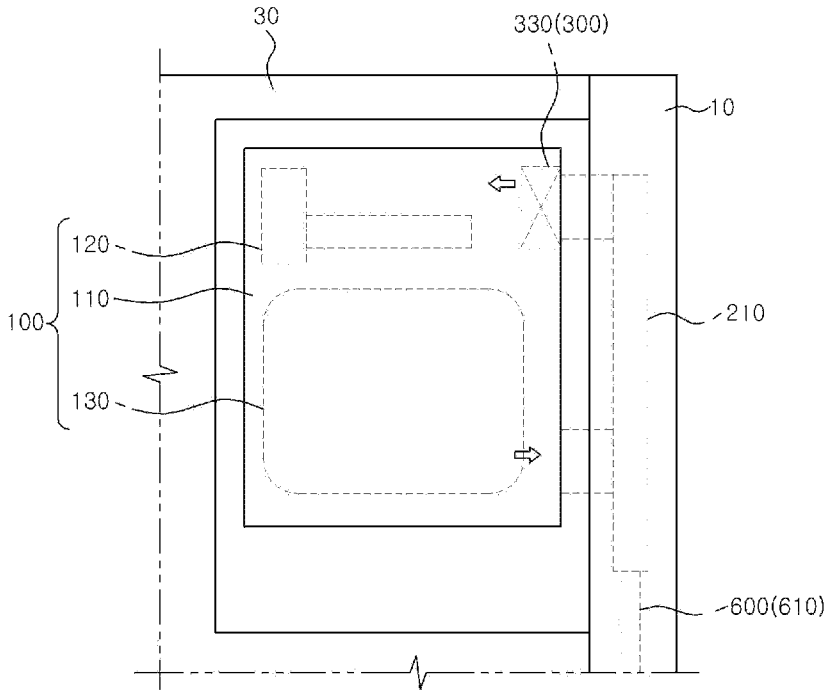
FIG. 3 is a cross-sectional view showing an internal construction of the ice making system for the refrigerator unit, in accordance with one embodiment of the present disclosure.

FIG. 1 is a perspective view showing an ice making system for a refrigerator unit, in accordance with one embodiment of the present disclosure. FIG. 2 is a view showing a connection between an ice making unit and a cooling duct of a cold air generator in the ice making system for the refrigerator unit of FIG. 1, in accordance with one embodiment of the present disclosure. FIG. 3 is a cross-sectional view showing an internal construction of an ice making system for the refrigerator unit of FIG. 1, in accordance with one embodiment of the present disclosure.

As shown in FIGS. 1 to 3, the ice making system for the refrigerator unit according to exemplary embodiments of the present invention can make ice cubes by freezing water using cold air produced from a cooling duct 210, and can efficiently drain defrost water produced from the cooling duct 210 to the outside.

in particular, the refrigerator unit 1 may include a refrigerator body 10 that defines an external appearance or exterior. A barrier 20 is configured for dividing the interior cavity of the refrigerator body 10 into a refrigeration compartment at the top thereof, and a freezer compartment at the bottom thereof. One or more doors may be configured to selectively isolate the interiors of the compartments from the surrounding environment. For example, a pair of refrigeration compartment doors 30 may be hinged to each of opposite edges of the front of the refrigeration compartment, and are configured through rotation thereof to selectively open and close the refrigeration compartment. A freezer compartment door 40 may be hinged to an edge of the front of the freezer compartment, and is configured through rotation thereof to selectively open and close the freezer compartment.

Although the refrigerator unit 1 of exemplary embodiments of the present invention is a bottom freezer type refrigerator in which the freezer compartment is provided in the lower part of the refrigerator body, it should be understood that embodiments of the present invention may be adapted to various types of refrigerators without being limited to the bottom freezer type refrigerator.

The ice making system of the present invention includes an ice making unit 100, a cold air generator 200, a cold air circulation unit 300, and a drainage unit 600.

Described in detail, the ice making unit 100 changes the phase of water to ice using cold air. The ice making unit 100 may be provided on an inner surface of the refrigeration compartment door 30. Although the ice making unit 100 of the present embodiment is provided on the upper part or portion of the refrigeration compartment door 30, the location is provided merely for illustration purposes only. It should be understood that the ice making unit 100 may be provided on another position of the refrigeration compartment door 30, in a different position within the interior of the refrigeration compartment, and the like.

The ice making unit 100 may include an ice making cabinet 110, an ice maker 120, and an ice bank 130.

In particular, the ice making cabinet 110 may be provided on the inside surface of the refrigeration compartment door 30, and may define an ice making space 111 in which ice cubes are produced. The ice maker 120 can freeze water using cold air flowing into the ice making space 111, such as when making ice cubes. The ice maker 120 can discharge the ice cubes into the ice bank 130. The ice bank 130 is provided at a location below the ice maker 120, and is configured to receive ice cubes discharged from the ice maker 120. The ice bank 130 can store the ice cubes discharged from the ice maker 120, and can dispense ice cubes to users using an ice dispenser unit (not shown).

The cold air circulation unit 300 functions to introduce cold air from the cold air generator 200 into the ice making space 111 of the ice making unit 100. The cold air circulation unit 300 may also be configured to discharge the cold air from the ice making space 111 to the cold air generator 200, to undergo a new refrigeration cycle.

For example, the cold air circulation unit 300 may include an inlet hole 310 provided on an upper part of the ice making unit 100 and an outlet hole 320 provided on a lower part of the ice making unit 100. The inlet hole 310 in the ice making unit 100 may be provided at a location corresponding to a first duct hole 212 of the cooling duct 210. The outlet hole 320 may be provided at a location corresponding to a second duct hole 213 of the cooling duct 210. A circulation fan 330 may be configured to circulate cold air from the inlet hole 310 to the outlet hole 320 through the ice making unit 100.

Accordingly, when the refrigeration compartment door 30 is closed onto the refrigerator body 10, the cold air inside the cooling duct 210 flows into the inlet hole 310 of the ice making unit 100 via the first duct hole 212. In the ice making unit 100, the cold air introduced from the cooling duct 210 circulates inside the ice making space 111 by the operation of the circulation fan 330. In that manner, water contained inside the ice making space 111 gradually freezes, and given enough refrigeration cycles ice cubes may be formed. Thereafter, the cold air circulating inside the ice making unit 100 may be discharged into the second duct hole 213 of the cooling duct 210 via the outlet hole 320. The cold air discharged from the ice making unit 100 is cooled again inside the cooling duct 210 prior to being reintroduced into the inlet hole 310, via the first duct hole 212, of the ice making unit 100.

The drainage unit 600 can efficiently drain defrost water produced from the cooling duct 210 to the outside.

In particular, the drainage unit 600 may include a hollow drain hose 610 through which defrost water can flow from the cooling duct 210 to be drained. A drain hose 610 may be connected to a lowermost bent portion of the cooling duct 210. A defrost water tray 50 is configured to collect the defrost water drained from the drain hose 610. Specifically, the drain hose 610 may be connected to a lower bent portion of the U-shaped cooling duct 210, such that the upper end of the drain hose 610 communicates and/or connects with the cooling duct 210. Thus, the drain hose 610 can efficiently drain the defrost water discharged from the cooling duct 210 onto the defrost water tray 50.

Figure 4:
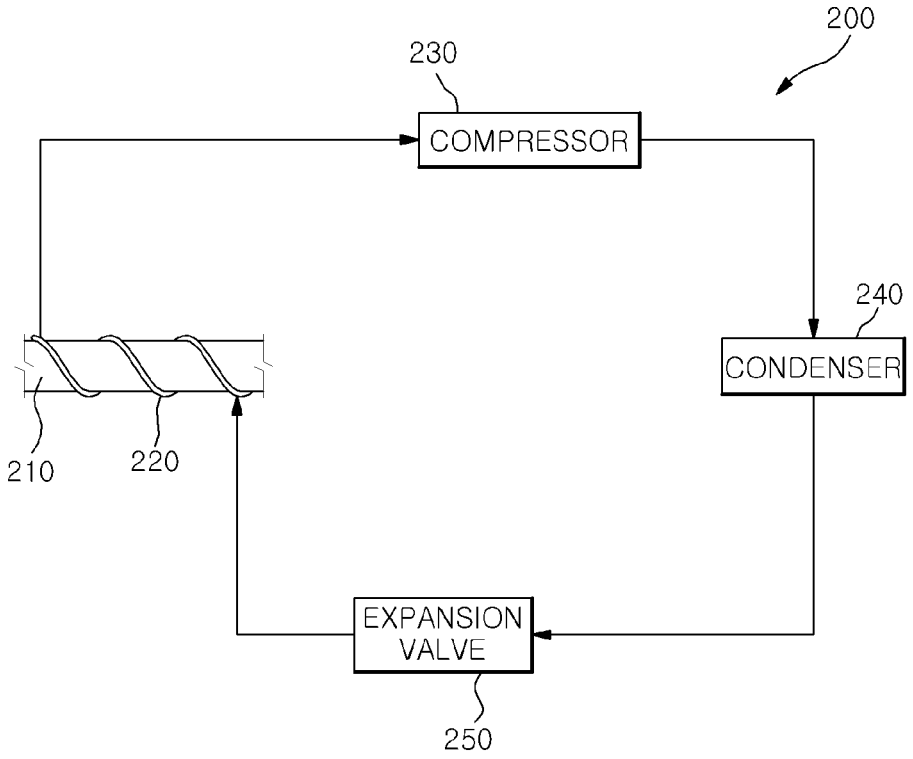
FIG. 4 is a block diagram the cold air generator of the ice making system for the refrigerator unit, in accordance with one embodiment of the present disclosure.
Figure 5:
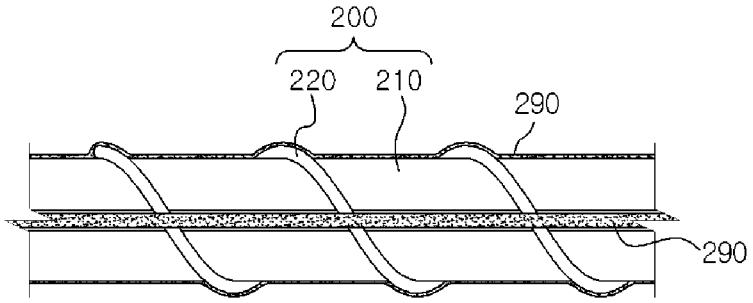
FIG. 5 is a view illustrating an ice making duct of the ice making system for the refrigerator unit, in accordance with one embodiment of the present disclosure.

FIG. 4 is a block diagram illustrating a cold air generator 200 of the ice making system for the refrigerator unit 1 of FIGS. 1 to 3, in accordance with one embodiment of the present disclosure. FIG. 5 is a view illustrating an ice making duct of the ice making system for the refrigerator unit 1 of FIGS. 1 to 3, in accordance with one embodiment of the present disclosure.

As shown in FIGS. 4 and 5, the cold air generator 200 can cool air flowing through the cooling duct 210, thereby producing cold air. The cold air generator 200 can supply the cold air to the ice making unit 100. The cold air generator 200 may be provided inside the refrigerator body 10 of the refrigerator unit 1. More specifically, the cold air generator 200 may be provided on the sidewall of the refrigerator body 10, in one embodiment. In another embodiment, the cold air generator 200 may be provided in the lower part of the refrigerator body 10.

The cold air generator 200 includes the cooling duct 210 that is provided in the sidewall of the refrigerator body 10. The cooling duct 210 is configured to form a cooling line through which air flows. An evaporation coil 220 is configured to be wound around the cooling duct 210, such that the air inside and traveling through the cooling duct is cooled by a heat exchanging operation between the air and a refrigerant. A compressor 230 is configured to compress the refrigerant discharged from the evaporation coil 220 so as to change the refrigerant to a high temperature and high pressure vapor or gas refrigerant. A condenser 240 is configured to condense the gas refrigerant so as to change the gas refrigerant to a high pressure liquid refrigerant. An expansion valve 250 is configured to perform adiabatic expansion of the liquid refrigerant, and supplies the refrigerant to the evaporation coil 220. A heater 290 is configured to defrost the cooling duct 210 by heating the duct 210, thereby producing defrost water.

In particular, the first duct hole 212 may be provided on the upper end of the cooling duct 210, such that the first duct hole 212 can communicate with, or is connected to, the inlet hole 310 of the ice making unit 100 when the refrigeration compartment door 30 is closed. The second duct hole 213 may be provided on the lower end of the cooling duct 210, such that the second duct hole 213 can communicate with, or is connected to, the outlet hole 320 of the ice making unit 100 when the refrigeration compartment door 30 is closed. Further, the heater 290 may include a heat transfer tape that covers the outer surface of the cooling duct 210 so as to provide heat to the cooling duct 210.

In some embodiments, the compressor 230, the condenser 240, the expansion valve 250, and the evaporation coil 220 are configured to implement a refrigeration cycle for the purpose of supplying cold air. The refrigeration cycle composed of four processes (e.g., compression, condensation, expansion, and evaporation) is performed in which a heat exchanging operation between air and refrigerant is implemented. Accordingly, air inside the cooling duct 210 may be cooled to become cold air by a heat exchanging operation performed between the air inside the cooling duct 210 and the refrigerant inside the evaporation coil 220. In particular, the evaporation coil 220 cools the cooling duct 210 through heat conduction. Further, the cooling line defined by and within the cooling duct 210 is sufficiently long such that air inside the cooling line can be efficiently cooled to become cold air. As such, when the air flows through the cooling line for a predetermined period of time (dependent in part on the length of and flow of air through the cooling duct 210), the air can be cooled to a predetermined temperature (for example, 14 degrees Fahrenheit below zero, or lower) at which the cold air can efficiently make ice cubes.

In one embodiment, the compressor 230, the condenser 240, and the expansion valve 250 may form a refrigeration cycle that can be implemented to supply cold air to both the refrigeration compartment and the freezer compartment of the refrigerator 1.

Figure 6:
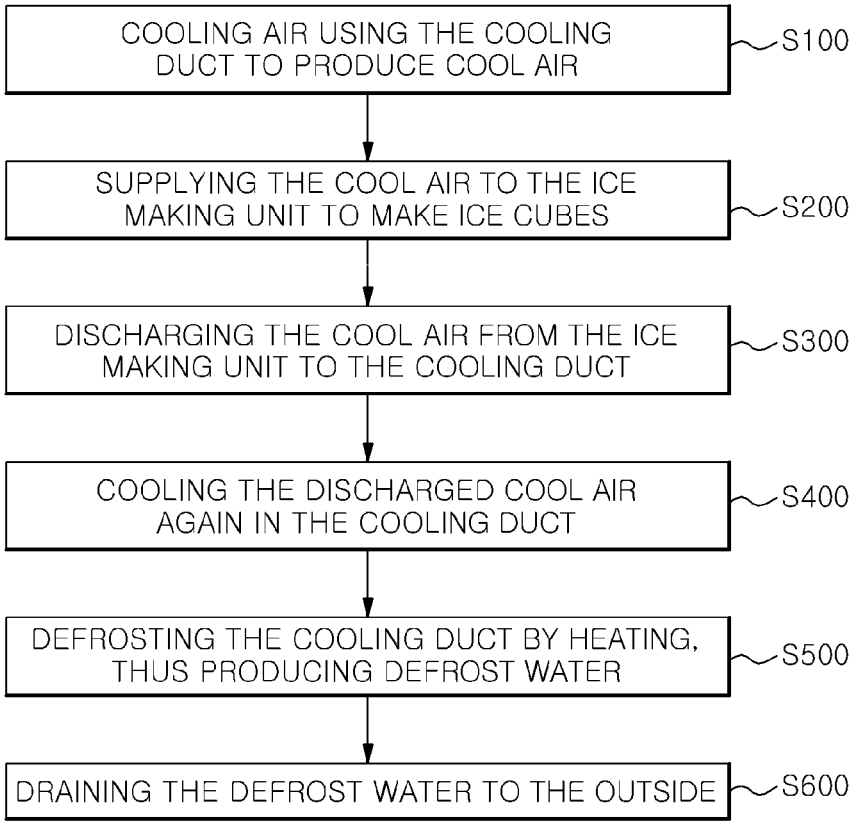
FIG. 6 is a flow diagram illustrating a method for making ice within a refrigerator unit, in accordance with one embodiment of the present disclosure.

FIG. 6 is a flow diagram illustrating a method for making ice in a refrigerator unit, in accordance with one embodiment of the present disclosure.

As shown in FIG. 6, the ice making method for the refrigerator unit may include: a step of cooling air using the cooling duct so as to produce cold air (S100); a step of supplying the cold air to the ice making unit so as to make ice cubes (S200); a step of discharging the cold air from the ice making unit to the cooling duct (S300); a step of cooling the discharged cold air again in the cooling duct (S400); a step of defrosting the cooling duct by heating the cooling duct, thereby producing defrost water (S500); and a step of draining the defrost water to the outside (S600) of the cooling duct.

In the step of cooling air using the cooling duct so as to produce cold air (S100), air is cooled to become cold air by making the air flow through the cooling duct on which the evaporation coil is wound. In this case, the air inside the cooling duct flows through the cooling line for a predetermined period of time while losing heat by the refrigerant flowing in the evaporation coil. In that manner, the air discharged from the cooling line can be cooled to a predetermined temperature (for example, 14 degrees Fahrenheit below zero, or lower) at which the cold air can efficiently make ice cubes.

In the step of supplying the cold air to the ice making unit so as to make ice cubes (S200), the cold air cooled in the cooling duct is supplied to the ice making space of the ice making unit through the inlet hole of the ice making unit. In particular, the cold air supplied to the ice making space circulates in the ice making space by operation of the circulation fan, and can freeze water contained inside the ice making space, thereby making ice cubes.

In the step of discharging the cold air from the ice making unit to the cooling duct (S300), the cold air is discharged from the ice making space into the cooling duct through the outlet hole of the ice making unit.

In the step of cooling the discharged cold air again in the cooling duct (S400), the cold air discharged into the cooling duct flows through the cooling line of the cooling duct for a predetermined period of time, thereby being cooled to a predetermined temperature or lower at which the cold air can freeze water to make ice cubes.

In the step of defrosting the cooling duct by heating the cooling duct, thereby producing the defrost water (S500), the heater is operated to defrost the cooling duct. In particular, the heater may be configured as a heat transfer tape that covers the surface of the evaporation coil. However, it should be understood that various heating units configured to heat the cooling duct may be used as the heater, without being limited to the heat transfer tape covering the surface of the evaporation coil.

In the step of draining the defrost water to the outside (S600), the defrost water produced from the step of defrosting the cooling duct is drained to the outside. In particular, the defrost water produced from the defrosted cooling duct is drained to the defrost water tray provided in a machine room of the refrigerator unit via the drain hose extending from the lower end of the cooling duct.

While the invention has been shown and described with respect to the exemplary embodiments, it will be understood by those skilled in the art that various changes and modifications may be made without departing from the spirit and scope of the invention as defined in the following claims.

The foregoing description, for purpose of explanation, has been described with reference to specific embodiments of an ice maker and a method for the same. However, the illustrative discussions above are not intended to be exhaustive or to limit the invention to the precise forms disclosed. It should be construed that the present invention has the widest range in compliance with the basic idea disclosed in the invention. Many modifications and variations are possible in view of the above teachings. Although it is possible for those skilled in the art to combine and substitute the disclosed embodiments to embody the other types that are not specifically disclosed in the invention, they do not depart from the scope of the present invention as well. The embodiments were chosen and described in order to best explain the principles of the invention and its practical applications, to thereby enable others skilled in the art to best utilize the invention. Further, it will be understood by those skilled in the art that various changes and modifications may be made without departing from the scope of the invention as defined in the following claims.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

Embodiments according to the invention are thus described. While the present disclosure has been described in particular embodiments, it should be appreciated that the invention should not be construed as limited by such embodiments.

What is claimed is:

1. An ice making system for a refrigerator, the ice making system comprising:

an ice making unit that makes ice cubes;

a cold air generator comprising a cooling duct provided in a refrigeration compartment to cool air inside the cooling duct so as to produce cold air to be supplied to the ice making unit;

a cold air circulation unit that supplies the cold air from the cooling duct of the cold air generator to the ice making unit and discharges the cold air from the ice making unit to the cooling duct of the cold air generator; and a drainage unit that drains defrost water produced from the cooling duct to the outside, wherein the drainage unit comprises a hollow drain hose through which the defrost water flows for draining;

wherein the cold air generator further comprises:

an evaporation coil wound around the cooling duct such that the air therein is cooled by a heat exchanging operation between the air and a refrigerant flowing through the evaporation coil;

wherein the cooling duct has a U-shape having a lowermost bent part and is disposed in a sidewall of a refrigeration compartment at the top of the refrigerator's body, and wherein the ice making unit is on a door of the refrigeration compartment, wherein the U-shaped cooling duct includes a first duct hole at one end thereof and a second duct hole at the other end thereof, and wherein the cold air circulation unit includes an inlet hole at an upper part of the ice making unit to be connected to the first duct hole when the door of the refrigeration compartment is closed and an outlet hole at a lower part of the ice making unit to be connected to the second duct hole when the door of the refrigeration compartment is closed so that the cooling duct communicates with the ice making unit, wherein the drain hose is connected to the lowermost bent part of the U-shaped cooling duct, wherein the cold air generator further comprises a heater including heat transfer tapes that partially cover an outer surface of the cooling duct by disposing the heat transfer tapes respectively on a top surface, side surfaces, and a bottom surface of the cooling duct and also cover parts of the evaporation coil that are disposed on the top surface, the side surfaces, and the bottom surface of the cooling duct, and wherein the heat transfer tapes defrost the cooling duct by heating the cooling duct, thereby producing defrost water.

2. The ice making system for the refrigerator according to claim 1, wherein the drainage unit further includes:

a defrost water tray that collects the defrost water drained from the drain hose.

3. The ice making system for the refrigerator according to claim 1, wherein the cold air generator comprises:

a compressor that compresses the refrigerant discharged from the evaporation coil so as to change the refrigerant to a high temperature and high pressure gas refrigerant;

a condenser that condenses the gas refrigerant so as to change the gas refrigerant to a high pressure liquid refrigerant; and an expansion valve that performs adiabatic expansion of the liquid refrigerant and supplies the refrigerant to the evaporation coil.

4. The ice making system for the refrigerator according to claim 3, wherein the evaporation coil functions as an evaporator of a refrigeration cycle, and cools the cooling duct through heat conduction.

5. The ice making system for the refrigerator according to claim 1, wherein the ice making unit comprises:

an ice making cabinet defining an ice making space;

an ice maker making the ice cubes using the cold air; and an ice bank storing the ice cubes.

6. The ice making system for the refrigerator according to claim 1, wherein the cold air circulation unit further comprises a circulation fan that circulates the cold air from the inlet hole to the outlet hole.

7. The ice making system for the refrigerator according to claim 1, wherein the refrigerator comprises a freezer compartment located within the body of the refrigerator, wherein the freezer compartment is located below the refrigeration compartment.

8. The ice making system for the refrigerator according to claim 7, wherein the drainage unit further includes:

a defrost water tray that collects the defrost water drained from the drain hose.

9. The ice making system for the refrigerator according to claim 7, wherein the ice making unit comprises:

an ice making cabinet defining an ice making space;

an ice maker making the ice cubes using the cold air; and an ice bank storing the ice cubes.

10. The ice making system for the refrigerator according to claim 7, wherein the cold air circulation unit further comprises a circulation fan that circulates the cold air from the inlet hole to the outlet hole.

11. The ice making system for the refrigerator according to claim 7, wherein the cold air generator comprises:

a compressor that compresses the refrigerant discharged from the evaporation coil so as to change the refrigerant to a high temperature and high pressure gas refrigerant;

a condenser that condenses the gas refrigerant so as to change the gas refrigerant to a high pressure liquid refrigerant; and an expansion valve that performs adiabatic expansion of the liquid refrigerant and supplies the refrigerant to the evaporation coil.

12. The ice making system for the refrigerator according to claim 11, wherein the evaporation coil functions as an evaporator of a refrigeration cycle, and cools the cooling duct through heat conduction.

13. An ice making method for a refrigerator, the method comprising:

cooling air flowing through a cooling duct provided in a refrigeration compartment to produce cold air;

supplying the cold air to an ice making unit so as to make ice cubes;

discharging the cold air from the ice making unit to the cooling duct;

cooling the discharged cold air again in the cooling duct;

defrosting the cooling duct by heating the cooling duct, thereby producing defrost water; and draining the defrost water to an outside, wherein the cooling of the air further includes providing an evaporation coil wound around the cooling duct such that the air flowing through the cooling duct is cooled by a heat exchanging operation between the air and a refrigerant flowing through the evaporation coil, wherein the draining of the defrost water further includes providing a hollow drain hose through which the defrost water flows for draining, and wherein the cooling duct has a U-shape and is disposed in a sidewall of a refrigeration compartment at the top of the refrigerator's body, and wherein the ice making unit is on a refrigeration compartment door of the refrigerator, wherein the U-shaped cooling duct has a lowermost bent part and includes a first duct hole at one end thereof and a second duct hole at the other end thereof, and wherein the cold air circulation unit includes an inlet hole at an upper part of the ice making unit to be connected to the first duct hole and an outlet hole at a lower part of the ice making unit to be connected to the second duct hole so that the cooling duct communicates with the ice making unit when the refrigeration compartment door is closed, and wherein the drain hose is connected to the lowermost bent part of the U-shaped cooling duct, wherein the cold air generator further comprises a heater including heat transfer tapes that partially cover an outer surface of the cooling duct by disposing the heat transfer tapes respectively on a top surface, side surfaces, and a bottom surface of the cooling duct and also cover parts of the evaporation coil that are disposed on the top surface, the side surfaces, and the bottom surface of the cooling duct, and wherein the heat transfer tapes defrost the cooling duct by heating the cooling duct, thereby producing defrost water.

14. The ice making method for the refrigerator according to claim 13, wherein the draining of the defrost water further comprises:

draining the defrost water produced from the defrosted cooling duct to a defrost water tray provided in a machine room of the refrigerator.

15. The ice making method for the refrigerator according to claim 13, wherein the cooling of the air further comprises:

flowing the air through a cooling line of the cooling duct for a predetermined period of time, thereby cooling the air to a predetermined temperature or lower and producing the cold air.

* * * * *